United States Patent [19]

Lieb

[11] 4,087,683

[45] May 2, 1978

[54] IMAGE INTENSIFYING DEVICE

[75] Inventor: Albert Lieb, Bellenberg, Germany

[73] Assignee: Licentia Patent-Verwaltungs-G.m.b.H., Frankfurt am Main, Germany

[21] Appl. No.: 715,173

[22] Filed: Aug. 17, 1976

[30] Foreign Application Priority Data

| | | |
|---|---|---|
| Aug. 29, 1975 | Germany | 2538447 |
| Mar. 13, 1976 | Germany | 2610601 |
| Apr. 15, 1976 | Germany | 2616624 |

[51] Int. Cl.[2] ..... H01J 31/50

[52] U.S. Cl. ..... 250/213 VT; 313/102

[58] Field of Search ..... 250/213 R, 213 VT; 313/94, 99, 102

[56] References Cited

U.S. PATENT DOCUMENTS

| | | | |
|---|---|---|---|
| 3,280,356 | 10/1966 | Stoudenheimer et al. | 250/213 VT |
| 3,708,673 | 1/1973 | Blacker | 250/213 VT |
| 3,916,240 | 10/1975 | Cuelenaere et al. | 313/102 |

*Primary Examiner*—David C. Nelms

*Attorney, Agent, or Firm*—Spencer & Kaye

[57] ABSTRACT

An image intensifying device including a light transmissive photocathode layer, a cathode electrode composed of two annular parts, the smaller of which is electrically connected to the photocathode layer, and an annular insulating part between the two electrode parts, and an anode provided with a fluorescent screen receiving electrons from the photoconductive layer, with the electrode parts being connected together by a high value intermediate resistance and the smaller electrode part being connected to the negative pole of a d.c. voltage source via a cathode resistance whose value is selected such that upon incidence on the photocathode layer of long term, high intensity optical radiation which would exceed the capacity of the screen, a high voltage drop appears across the cathode resistance to prevent the energy of the electrons striking the screen from exceeding its capacity, while the capacitances existing between the anode and each annular part protect the screen from damage upon the occurrence of rapid optical radiation intensity increases.

23 Claims, 10 Drawing Figures

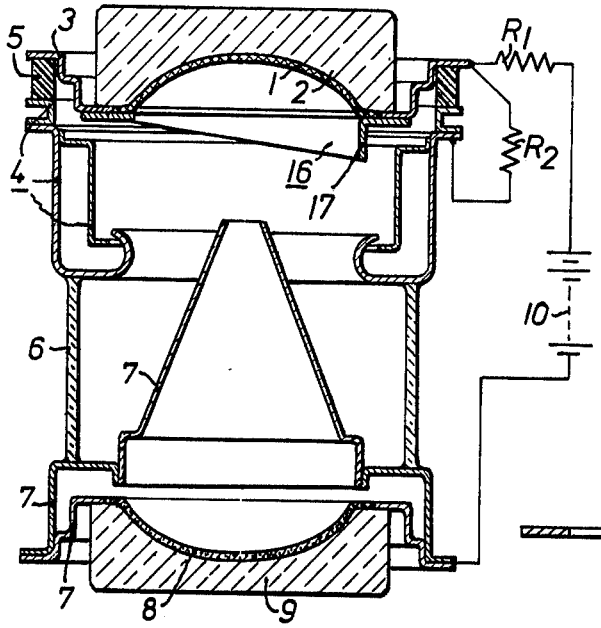
FIG. 5
FIG. 6
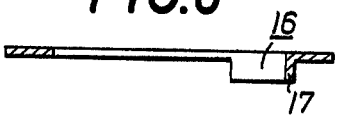
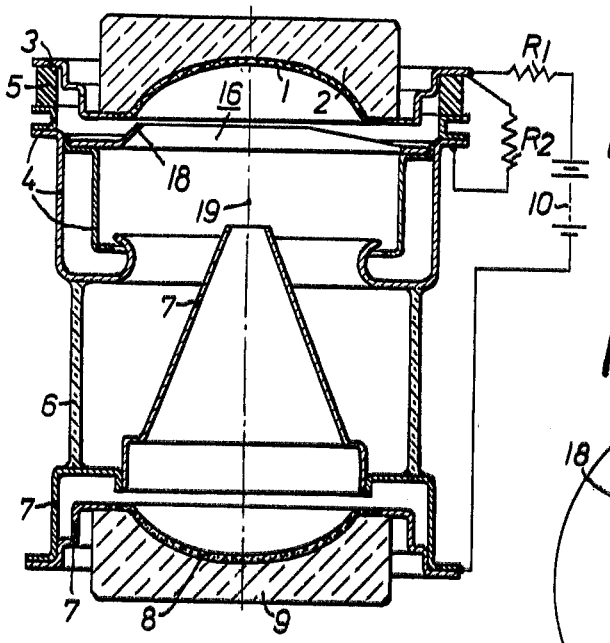
FIG. 7
FIG. 8
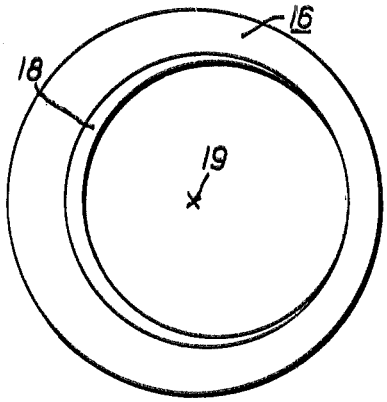

IMAGE INTENSIFYING DEVICE

BACKGROUND OF THE INVENTION

The present invention relates to an image intensifying device, having a photocathode layer arranged on the inner surface of a light-transmissive photocathode carrier and a cathode electrode, which has a first annular electrode part connected electrically to the photocathode layer and a second annular electrode part and which is connected to the negative pole of a direct current voltage source.

Proposals have already been made for protecting electronic image intensifying devices with regard to a sudden sharp increase in the incident light or beam intensity and for protecting the fluorescent screen from being burnt by connecting the photo-emissive layer of the cathode to a good electrically conductive edge and a remaining part of this electrode which acts as a focusing means, via a vacuum deposited resistance layer of such high electrical resistance that, when there is an increase in the intensity, a voltage difference arises between the good conductive edge and one of the focusing means and that the electron beam is thus defocused and/or deflected.

This type of image intensifying device has the disadvantage that, in order to achieve adequate protection (particularly at the center of the fluorescent screen), the properties for transmitting the image are restricted even under normal operating conditions (particularly when observing brightly illuminated objects) by reduced resolution, distorted image reporduction and a restriction in the useful image size. Above all, this is because the image-producing electron beam is already defocused and/or deflected when the photocathode of the tube is acted upon by a beam which is compatible with the anode of the fluorescent screen without any permanent destruction thereof. This is particularly true for the zones of the photocathode adjacent the conductive edge. A further disadvantage is produced if, as usual, the tube is operated by a voltage supply which limits the maxmum current which flows in the tube. With this type of voltage supply the tube cannot be operated even during daylight without damage. A current-limiting voltage supply is used particularly if several image intensifying tubes are placed in a two or three stage cascade arrangement. Current limitation is then selected so that the load of the anode of the fluorescent screen of the image-intensifying tube, which is located at the final stage, is not exceeded.

When using image-intensifying devices of this type, there is the further disadvantage that, when observing bright image scenes, there is a shrinkage of the electron beam from the edge as a result of the potential difference arising between the good conductive edge of the photo-emissive layer and the remaining part of the cathode electrode, acting as a focusing means. With very bright image scenes, the image appearing on the fluorescent screen is reduced to a small fraction of its original dimensions. The current controlled voltage supply limits the current flowing in the tube independent of this focusing effect. As a result of the greatly reduced image size, however, the permissible surface loading of the fluorescent screen is exceeded. In order to avoid this, limiting current in the voltage supply has to be so designed that it limits the current at substantially smaller values. However, this would produce a restriction in the optical output and a narrowing of the range of intensity of scene illumination, in order for the image-intensifying tube to supply useful image information.

SUMMARY OF THE INVENTION

The object of the invention is to create an image intensifying device which is protected effectively with regard to incident radiation intensity, particularly a sudden radiation intensity, and which, during normal operation, permits observation without a deleterious effect on sharpness of image, distortion of image, restriction of the useful image field or overloading of the fluorescent screen over a large range of illumination intensities.

According to a first aspect of the invention, there is provided an image intensifying device comprising a light transmissive photocathode layer, a cathode electrode including a first annular electrode part electrically connected to said photocathode layer, a second annular electrode part of larger area than said first annular electrode part, an annular insulating part between said first annular electrode part and said first annular electrode part, a high value electrical intermediate resistance connecting said first annular electrode to said second annular electrode a d.c. voltage source, and a high value cathode resistance connecting said first annular electrode part to the negative pole of said d.c. voltage source.

According to a second aspect of the invention, there is provided an image intensifying device having a photocathode layer applied to an inner surface of a light transmissive photocathode carrier and having a cathode electrode, which has a first annular electrode part connected electrically to said photocathode layer and has a second annular electrode part and which is connected to the negative pole of a d.c. voltage source, characterised in that said second electrode part is connected to said first electrode part, an annular insulating part being inserted therebetween, that said first electrode part has a smaller area than said second electrode part that said first electrode part is connected to said second electrode part via a high value electrical intermediate resistance and that said first annular electrode part is connected electrically to said negative pole of said voltage source via a high value cathode resistance, the resistance value of said cathode resistance being selected so that when there is an optical radiation, which would exceed the loading capacity of the fluorescent screen, acting intensely over a long period of time on said photocathode layer, a high voltage drop occurs across said cathode resistance so that the energy of the electrons meeting said fluorescent screen does not exceed the loading capacity of said fluorescent screen.

BRIEF DESCRIPTION OF THE DRAWINGS

The invention will now be described in greater detail, by way if example, with reference to the drawings, in which:

FIG. 5 is a view similar to FIG. 1, but showing a third form of image intensifying tube in accordance with the invention;

FIG. 6 is a sectional view of the focussing ring shown in FIG. 5;

FIG. 7 is a view similar to FIG. 1, but showing a fourth form of the invention;

FIG. 8 is a plan view of the focussing ring shown in FIG. 7;

DESCRIPTION OF THE PREFERRED EMBODIMENTS

Figure 1:
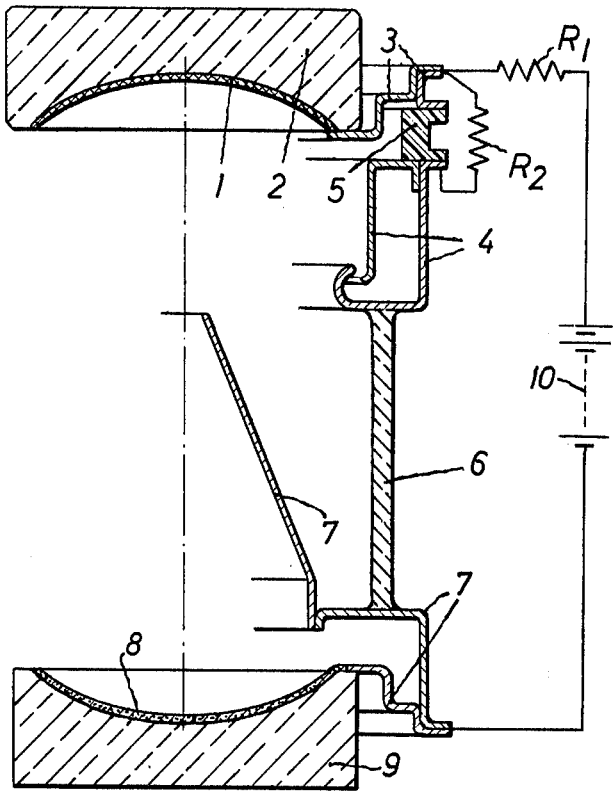
FIG. 1 shows schematically a preferred embodiment of the invention and represents an image intensifying tube.
Figure 2:
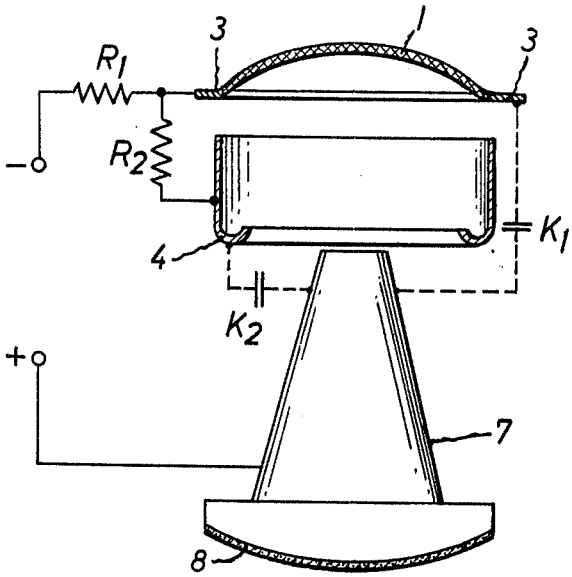
FIG. 2 shows schematically the electrical circuit formation of a device having a diode image intensifier as shown in FIG. 1.

In FIGS. 1 and 2, the cathode electrode of the image-intensifying tube comprises two electrically insulated parts 3 and 4. Part 3 is formed in an annular shape and has a smaller surface and has an electrically conductive connection with the photoemissive layer 1, which is arranged on the photocathode carrier 2. The other part 4 which has a larger surface is formed substantially cylindrically and is adjacent the anode 7. The electrode part 4 is connected to the annular electrode part 3 by means of an insulating part 5 and is connected by a high value resistor $R_2$ arranged within or outside the tube bulb, or vacuum chamber. The annular part 3 which is in contact with the photo-emissive layer 1, is connected to the negative pole of a voltage source 10 via a resistor $R_1$ which is designated below as a cathode resistor. This cathode resistor $R_1$ is so dimensioned that, when there is a fairly long acting intensive beam effect which would exceed the loading capacity of the illuminating screen 8, a voltage drop occurs across said resistor and is of such a size that the energy of the electrons meeting at the fluorescent screen 8 does not lead to any damage to the fluorescent screen. The construction of the cathode electrode in accordance with the invention, which is in two parts, prevents the loading capacity of the fluorescent screen 8 from being exceeded even with a very rapid sudden incidence of an intensive beam on to the photocathode 1. On the one hand, this is a result of the low capacitance $K_1$ between the electrode part 3 connected to the photo-emissive layer and the anode electrode 7. The electrical charge stored in this capacitance is so low that the electron flood produced does not damage the usual type of fluorescent screen. The substantially larger charge stored in the capacitance $K_2$ between the cylindrical part 4 and the anode 7 flows, after a time delay, to the anode 7 of the fluorescent screen, which flow is determined by the resistance $R_2$ arranged between the two electrode parts. The loading of the fluorescent screen 8 is reduced per unit of time to a harmless value. In addition, voltage differences which lead to defocusing and/or deflection of the electron beam passing between the cathode and anode electrodes, occur for a short period of time between two electrode parts 3 and 4. This reduces the loading of the fluorescent screen still further particularly if the intense radiation is effected on small areas of the photocathode, as the electron beam meeting the fluorescent screen is moved backwards and forwards on a larger area of the fluorescent screen than that which corresponds to the incident beam of rays. After the charge has drained away from the capacitance $K_2$, the annular electrode part 3 and the cylindrical electrode part 4 are at the same potential. The electron optical properties of the tube, such as sharpness of image, geometry of image and image field, are not reduced even with strong radiation on the photocathode. The resistor $R_2$ arranged between the two electrode parts 3 and 4 is so dimensioned that discharging of the capacitance $K_2$ which is constant in terms of time is smaller than the perception of the eye, i.e. below 0.1 s.

The image-intensifying tube is rotationally symmetrical. The photocathode layer 1 and the fluorescent screen layer 8 are preferably located on a concave surface of a photo-conductive fibre disc 2 or 9. The vacuum envelope is formed by the photocathode carrier disc 2, the electrode part 3, the insulating ring 5, the electrode part 4, the cylindrical glass tube 6, parts of the anode electrode 7 and the fluorescent screen carrier 9, which are connected together vacuum-tight. The insulating ring 5 preferably comprises a ceramic material. It may possibly be advisable to manufacture this ring 5 from a material which is semiconductive so that at the same time the ring forms the resistor $R_2$.

The size of capacitances $K_1$ and $K_2$ shown in broken lines in FIG. 2 is determined by the type of construction; however they cannot be less than the value which would be negligible in the case of transient occurrences. The fluorescent screen 8 carries the potential of the anode electrode 7 and the photocathode layer 1 carries the potential of the cathode ring 3. The cylindrical cathode part 4 is double-walled for producing the photocathode and has an inwardly projecting torus at its anode side, which torus brings about the desired construction of the electrical focusing field between the photocathode and the anode and prevents undesirable discharge phenomena from occurring between the anode electrode 7 and the cathode ring 3.

It is advisable for the resistance value of the cathode resistor $R_1$ to be approximately 0.5 to 2 powers of 10 less than the intermediate resistor $R_2$. In a preferred example $R_1$ was approximately $5 \cdot 10^8$ ohms and the intermediate resistor $R_2$ approximately $5 \cdot 10^9$ ohms.

In accordance with a further embodiment of the invention the cylindrical electrode part may have a rotationally symmetrical annular diaphragm, the electron orifice of which is dimensioned so that it closely confines the electron beam emitted by the effective photocathode layer and the ring of which, which forms the electron orifice, is so arranged that it is located in close proximity to the photocathode layer.

In accordance with a further improvement, a capacitor between 5 and 2000 pF is provided between the cylindrical electrode part 4 and the negative pole of the voltage source 10.

Figure 3:
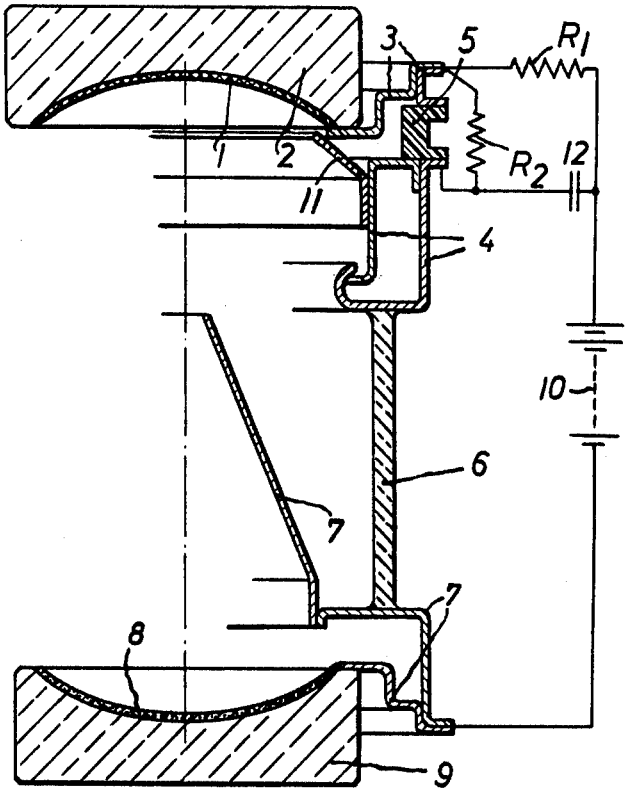
FIG. 3 is a view similar to FIG. 1, but showing a modified form of image intensifying tube.
Figure 4:
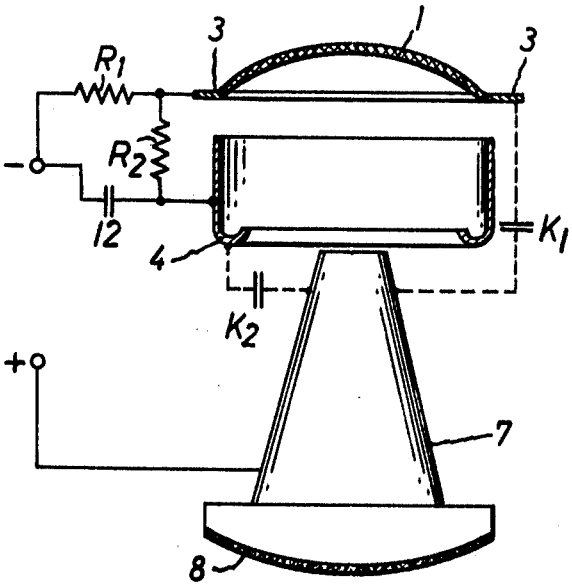
FIG. 4 is a view similar to FIG. 2, but showing the image intensifier of FIG. 3.

These improvements will be described in greater detail below together with the preferred embodiments of the invention shown in FIGS. 3 and 4.

Again, the same parts are designated with the same reference symbols. The image intensifying tubes are constructed to be rotationally symmetrical. FIG. 4 shows a more schematic view, while FIG. 3 shows in cross-section, the construction of such an image intensifying tube schematically.

The image intensifying tube has a photocathode carrier 2 which allows the passage of the optical rays to be intensified. The photocathode carrier 2 comprises for example a photoconductive fibre disc on the inner concave surface of which is arranged the photocathode layer 1 which is in electrically conductive connection with the electrode part 3 of the photocathode electrode. A cylindrical electrode part 4 is connected vacuum-tight to the electrode part 3 via an annular insulating part 5. The two parts 3 and 4 together form the photocathode electrode and under normal operation have approximately the same potential. A high value resistance $R_2$ of the order of magnitude of approximately $5 \cdot 10^8$ ohms connects the two electrode parts 3 and 4 together. The elecrrode part 3 is connected via a high value resistance $R_1$ of the order of magnitude of approximately $5 \cdot 10^8$ ohms to the negative pole of the voltage source 10.

A cylindrical glass part 6 is connected in vacuum-tight manner to the anode electrode 7, which in turn has a fluorescent screen carrier 9 which permits the passage of optical rays, the fluorescent screen 8 is located on the concave inner surface of the said carrier.

The anode electrode 7 is in electrical connection with the fluorescent screen 8 and the positive pole of the voltage source 10. The capacitances determined by construction and located between the individual electrode parts are designated $K_1$ and $K_2$ in FIG. 4. The two part construction of the cathode electrode prevents the loading capacity of the fluorescent screen 8 from being exceeded even when there is a very rapid sudden intensive incidence of radition on to the photocathode 1. This occurs as a result of the low capacitance $K_1$ between the electrode part 3 connected to the photocathode layer 1 and the anode electrode 7. The charge stored in the capacticance determined by construction is so small that the electron flood produced thereby does not normally damage the fluorescent screen. The substantially large charge stored in the capacitance $K_2$ determined by construction, said capacitance lying between the cylindrical electrode part 4 and the anode 7, flows with a time delay to the fluorescent screen anode 7 in dependence on the high value resistance $R_2$. Loading of the fluorescent screen 8 per unit time is thus reduced. In addition, a voltage difference which leads to defocusing and/or deflection of the electron beam emitted by the cathode layer, occurs between the two electrode parts 3 and 4 for a short period of time. Moreover, the electron flood is reduced or completely interrupted in the edge areas of the photocathode with an increasing voltage difference and thus the electron beam is restricted and constricted from the edge. The cross-section of the electron beam is thus continuously reduced. This means that, with a certain voltage difference between the electrode parts 3 and 4 electrode there will no longer be any electron flux whatsoever between the photocathode layer and the anode i.e. the electron flood is blocked and the tube is completely protected with respect to an intensive attack of light. The necessary voltage difference for this is referred to below as a blocking voltage.

An annular diaphragm 11 is arranged on the cylindrical electrode part 4, as shown in FIGS. 1 and 2, in order to increase the protective effect; said annular diaphragm surround the electron beam emitted by the photocathode layer 1 as closely as possible around its circumference, however without having a blocking effect during normal operation. This annular diaphragm 11 is so arranged in accordance with the invention that the edge surrounding the electron beam is located in the closet possible proximity to the cathode electrode 1. Lastly, this spacing is only limited by the fact that there should be no arc-over between the photocathode layer 1 and this annular diaphragm 11 when the voltage differences occur. With this tube construction in accordance with the invention and defocusing deflecting constricting and blocking effect of the two part cathode electrode on the electron beam passing between the photocathode layer and the anode electrode improves and thus substantially increases the protective effect. This is effected above all by reducing the blocking voltage.

In the preferred embodiment shown, this annular diaphragm 11 projects into the discharge chamber and surrounds the electron beam, which passes from the photocathode 1 to the fluorescent screen 8 with a small spacing. The part which has the smallest spacing from the longitudinal axis of the tube is located in the direct vicinity of the photocathode 1. This may be achieved particularly favourably by means of a frusto-conical sleeve-shaped construction of the sleeve surface, as shown. As a result of this annular diaphragm 11, the electron emission of the photocathode layer is reduced or eliminated or blocked between the annular electrode part 3 and the cylindrical electrode part 4 when there is a very low voltage difference.

A further improvement of such a protective effect against excessive brightness in an image-intensifying valve may be achieved by connecting the capacitance 12 between the cylindrical electrode part 4 and the negative pole of the voltage source 10, the capacitance of which is preferably from about 10 to approximately 500 pF. This additional capacitance causes the voltage difference, which is produced during sudden radiation arriving at the photocathode layer 1, between the electrode part 4 and the electrode part 3, to be maintained until the voltage drop at the high value resistance $R_1$ is sufficiently large that the loading capacity of the fluorescent screen 8 is no longer exceeded.

A further improvement in the invention envisages creating an image intensifier tube which is protected in a particularly effective manner with regard to an intensive sudden and particularly punctiform radiation arising at the centre parts of the photocathode and which facilitates observation in a large range of illumination intensities during normal operation, without restricting the quality of the image and the useful image field.

This further improvement is that at least one of the two electrode parts 3, 4 are constructed so that they are not rotationally symmetrical, so or are rotationally asymmetrical that when applying a voltage difference between these two electrode parts a deflection of the electrons emitted by the photocathode layer is brought about transverse to the longitudinal axis of the tube.

If a tube which has been constructed in this manner is suddenly acted upon by an intense optical radiation, then a correspondingly high emission is produced by the photocathode. The emissive electrons are taken substantially from the electrical charge of the capacitor which is formed by the electrode part, which contains the photocathode, relative to the anode electrode. The voltage between the part of the cathode electrode emitting electrons and the fluorescent screen anode is lowered by the emission flow until the voltage drop across a resistor which is connected to the negative pole of the voltage source is so large that it may subsequently supply the current through the resistor. The resistor which connects the two electrode parts together and the capacitance which the non-emissive electrode part has relative to the remaining valve electrodes and earth are so dimensioned that the potential of the non-emissive electrode part is not reduced, or not reduced substantially relative to the anode electrode.

Thus a voltage difference occurs between the two electrode parts, said difference being increased with time after the first impact of radiation.

As a result of the construction of at least one of the two parts of the cathode electrode as above described said construction not being rotationally symmetrical, the electron beam passing between the photocathode and the anode electrode is sharply deflected between the two parts of the cathode electrode, when there is a voltage difference, substantially perpendicular to the longitudinal axis of the tube. The place at which the electrons emitted by the photocathode meet on the fluorescent screen is constantly changed until uniformity of voltage is set between the two parts of the cathode electrode. The size of the deflection is substantially dependent on the areas of the photocathode which are acted upon by radiation. In particular, electron beams which arise as a result of the action of radiation of central parts of the photocathode, are also sharply deflected.

As a result of the change in time of the place at which the electron beam meets on the fluorescent screen during the initial phase of the intense radiation, the surface loading of the fluorescent screen is sharply reduced. A high protective effect relative to an intense and sudden radiation, particularly punctiforn radition, is produced particularly if the radiation takes place in the central regions of the image intensifying tube.

The emission flow is taken from the operating voltage source during the period of time following the initial phase of radiation. Thus there is a voltage drop across the resistance which connects the cathode electrode to the voltage source, said voltage drop lowering the potential of the cathode electrode relative to the fluorescent screen anode. This resistance is is dimensioned so that, during the emission flow of the photocathode which occurs during intense radiation, the energy of the electrons meeting on the fluorescent screen is reduced until the loading capacity of the fluorescent screen is not exceeded.

In order to avoid a restriction of the image properties such as indistinct image reproduction, distortion of image, restriction of the useful image field and the like from occurring during normal operation of the valve, provision is made for the potential balance of the two parts of the cathode electrode to take place during a period which is smaller than the perception of the eye. In accordance with the invention this is effected by having a time constant smaller than 0.1 s, said time constant being produced from the product $R_2 \cdot C_{k2}$. The value of $R_2$ is thus the resistance between the two parts of the cathode electrode and the value of $C_{k2}$ is the capacitance between the part 4 of the cathode electrode, which emits no electrons, and the remaining electrode as well as the earth.

Preferred embodiments of the improvement of the invention are described together with FIGS. 5 to 10 and are illustrated in greater detail. FIG. 5 shows a form of construction of the tube in accordance with the invention in longitudinal section together with the part supplying voltage. The cathode electrode of the image-intensifying tube comprises two insulated electrode parts 3 and 4. The electrode part 3 contains the layered photocathode 1 on a fibre optics disc 2. An electrically conductive connection exists between the photocathode layer 1 and the sheet metal ring 3 as well as an annular part 16 which is not rotationally symmetrical. The fibre optics disc 2 acts as a window for the radiated image, which is to be intensified. The ring 3 and thus also the photocathode 1 are connected to the negative pole of the operating voltage source 10 via a high value resistance $R_1$, which is designated below as a cathode resistor.

The described tube comprises moreover an anode having electrically conductive parts 7 and contains a further fibre optics disc 9 on the concave inner surface of which is arranged the layered fluorescent screen 8 which is connected to the anode part 7 so as to be electrically conductive. The anode electrode 7 is connected to the positive pole of the voltage source 10. A cylindrical glass part 6 completes the vacuum envelope of the tube. With the exception of the annular part 7, which is not rotationally symmetrical, the described tube parts are constructed in known manner rotationally symmetrical about the longitudinal tube axis.

The electrode part 4 of the cathode electrode is larger in size. An insulating piece 5, e.g. made of glass or ceramics, is located between the two parts 3 and 4 of the cathode electrode. The electrical connection of the two electrode parts 3 and 4 takes place by means of a high value resistance $R_2$. This may be located within or outside the tube bulb. Below, this is designated as a connecting resistor. It may be advisable to provide the sleeve surface of the insulating piece 5 inside or outside the tube casing with a layer, which produces the resistance $R_2$. A further form is to manufacture the ring 5 from a material which itself forms the resistance $R_2$.

The ring part 3 not rotationally symmetrical has a cylindrical part 16 which is located preferably in the immediate vicinity of photocathode layer 1. This part 16 is thus located in the part of the discharge chamber in which the electrons emitted by the photocathode have a low speed and have covered a relatively small distance. The extent of 17 along the tube axis of the cylindrical part 16 is very variable along the circumference. The electrode part 3 of the cathode electrode in the discharge region exhibits a sharp deviation in its rotational symmetry with respect to the longitudinal axis of the tube. The voltage difference arising initially in an intensive radiation between the two parts 3 and 4 of the cathode electrode thus leads to a sharp deflection of the electron beam emitted by the photocathode. Thus a correspondingly sharp reduction in the loading of the fluorescent screen 8 occurs.

In order to achieve deviation from the rotational symmetry of part 3 of the cathode electrode, there is provision for the cylindrical part 17 of the focusing ring 16 to be arranged only on a small part of the circumference. Such an embodiment of the ring part 16 which is not rotationally symmetrical is shown in cross-section in FIG. 6.

A further embodiment is shown in longitudinal section in FIG. 7. The same reference symbols are used in the embodiment of FIG. 7 as in the other embodiments for the same parts of the tube and of the voltage supply and further description of these parts has been dispensed with. In the embodiment of FIG. 7, the part 4 of the cathode electrode is connected to the ring part 16 which is not rotationally symmetrical and which is located directly adjacent the photocathode layer 1. Thus ring part 16 has a frusto-conical part 18, the extent of which along the longitudinal axis 19 of the tube is constant along the majority of its circumference and varies over a smaller part of the circumference; moreover, the spacing of the conical part 18 from the longitudinal axis of the tube is changed along its circumference. In FIG. 8, this ring part 16 is shown in plan view. The change in the spacing of the conical part 18 with respect to the longitudinal axis 19 of the tube along the circumference may be seen therefrom.

Figure 9:
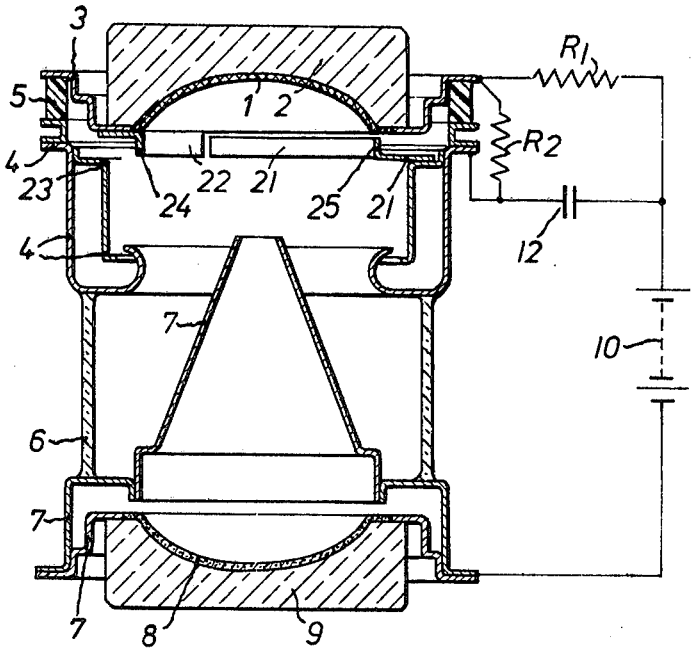
FIG. 9 is a view similar to FIG. 1, but showing a fifth form of the invention.
Figure 10:
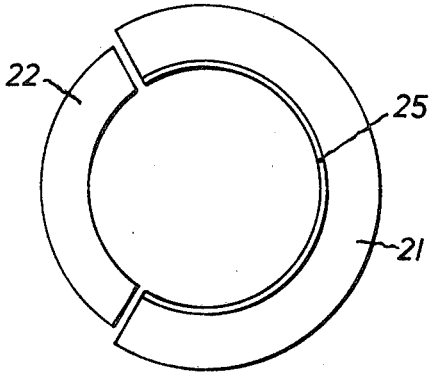
FIG. 10 is a plan view of the focussing ring shown in FIG. 9.

FIG. 9 shows a further embodiment in longitudinal section. The particular feature of this embodiment lies in the fact that each of the two parts 3 and 4 of the cathode electrode has sharp deviations from its rotational symmetry in the emission region of the tube with respect to the longitudinal axis of the tube. Preferably, rotational symmetry should exist with respect to the effect on the electrons when there is the same potential in both Parts 3 and 4. The electrical asymmetry provided takes place if there is a voltage difference between the two parts 3 and 4 of the cathode electrode. This effect is achieved in the present embodiment in that an asymmetrical electrode part 22 is arranged on the annular sheet part of the electrode part 3 of the cathode electrode and an asymmetrical electrode part 21 is arranged on the annular surface 23 of the part 4 of the cathode electrode, these asymmetrical electrode parts having two parts 24 and 25 which are located in the immediate vicinity of the photocathode layer 1. The part 25, i.e. the part which is connected to the part 4 of the cathode electrode, preferably extends over a larger part of the circumference than the part 24 which is connected to the part 3 of the cathode electrode. Moreover, the parts 24 and 25 have a constant spacing, along the circumference from the longitudinal axis of the tube and their extents along the longitudinal axis of the tube are of the same magnitude around the whole circumference. In FIG. 10 the two asymmetrical electrode parts 21 and 22 are shown in plan view.

The part 4 of the cathode electrode is connected to the part 3 of the cathode electrode via the connecting resistance $R_2$, as in the preceding embodiments. The size of this resistance $R_2$ and the capacitance of the part 4 of the cathode electrode, which is designated $C_{k2}$ hereafter, determines the time period, relative to the other tube electrodes and earths until after the photocathode has been acted upon by an intense radiation the condition of equality of voltage between the parts 3 and 4 of the cathode electrode is achieved. The time constant which is produced from the product $R_2 \cdot C_{k2}$ is less than the perception of the eye and is approximately 0.1 sec, but is preferably not substantially less than that.

As it is difficult to achieve very high resistance values for the connecting resistance $R_2$ as a result of uncontrollable internal transmission resistances in the image intensifying tube e.g. as a result of alkali evaporation on to the insulating piece 5, it is envisaged that the capacitance $C_{k2}$ of the part 4 of the cathode electrode is increased by an additional capacitance arranged outside the tube. In the present embodiment of FIG. 10, this is realized by means of a capacitor 12 which is connected between the electrode part 4 and the negative pole of the operating voltage source 10. This capacitor has a value of approximately 2 to approximately 100 pF according to the size of the connecting resistor $R_2$.

It is advisable for the cathode resistance $R_1$ to have a value of between $10^7$ and $5 \cdot 10^9$ ohms. The intermediate resistance $R_2$ preferably has a value greater than $10^8$ ohms, more particularly a value between $10^9$ and $10^{11}$ ohms.

It will be understood that the above description of the present invention is susceptible to various modification changes and adaptations.

What is claimed is:

1. An image intensifying device having a photocathode layer applied to an inner surface of a light-transmissive photocathode carrier and having a cathode electrode, which has a first annular electrode part connected electrically to said photocathode layer and has a second annular electrode part and which is connected to the negative pole of a d.c. voltage source, the device further including an anode electrode provided with a fluorescent screen, characterized in that said second electrode part is connected to said first electrode part by an annular insulating part inserted therebetween, that said first electrode part has a smaller area than said second electrode part, that said first electrode part is connected to said second electrode part via a high value electrical intermediate resistance, and that said first annular electrode part is connected electrically to said negative pole of said voltage source via a high value cathode resistance, the resistance value of said cathode resistance being selected so that when there is an optical radiation, which would exceed the loading capacity of said fluorescent screen, acting intensely over a long period of time on said photocathode layer, a high voltage drop occurs across said cathode resistance so that the energy of the electrons meeting said fluorescent screen does not exceed the loading capacity of said fluorescent screen.

2. A device as defined in claim 1, wherein said intermediate resistance has approximately a value of $10^8$ to $10^{11}$ ohms.

3. A device as defined in claim 2, wherein said intermediate resistance has a value between $10^9$ and $10^{11}$ ohms.

4. A device as defined in claim 1 presenting a vacuum chamber enclosing the region between said photocathode layer and said screen, and wherein said intermediate resistance is arranged inside said vacuum chamber.

5. A device as defined in claim 1 presenting a vacuum chamber enclosing the region between said photocathode layer and said screen, and wherein said intermediate resistance is arranged outside said vacuum chamber.

6. A device as defined in claim 1, wherein said intermediate resistor comprises a semiconductive construction of said annular insulating part.

7. A device as defined in claim 1, wherein said first electrode part and said second electrode part are constructed so that the capacitance formed between said anode electrode and said first electrode part is at most half of the capacitance which is formed between said second electrode part and said anode electrode.

8. A device as defined in claim 1, wherein said first electrode part and said second electrode part are constructed so that the capacitance formed between said anode electrode and said first electrode part is less than one fourth of the capacitance which is formed between said second electrode part and said anode electrode.

9. A device as defined in claim 1, wherein said first electrode part and said second electrode part are constructed so that the capacitance formed between said anode electrode and said first electrode part is less than one eighth of the capacitance which is formed between said second electrode part and said anode electrode.

10. A device as defined in claim 1, wherein said cathode resistor has a resistance value of approximately $10^7$ to $5 \cdot 10^9$ ohms.

11. A device as defined in claim 1, wherein said second electrode part has a rotationally symmetrical annular diaphragm, with an electron passage opening dimensioned so that it closely surrounds an electron beam emitted by said effective photocathode layer and with the edge forming the electron passage opening arranged to be located closely adjacent said photocathode layer.

12. A device as defined in claim 11, wherein said annular diaphragm is frusto-conical and is arranged with its end with the smaller diameter closely adjacent said photocathode layer.

13. A device as defined in claim 1, and comprising a capacitance of approximately 1 up to 2000 pF, connected between said negative pole of said voltage source and said second electrode part.

14. A device as defined in claim 13, wherein said capacitance has a value between 2 and 200 pF.

15. A device as defined in claim 1, wherein at least one of said two electrode parts is constructed to be rotationally a symmetrical so that when there is a voltage difference between these said two electrode parts and a deflection in the electrons emitted by said photocathode layer occurs which is transverse to the longitudinal axis of the tube.

16. A device as defined in claim 15, wherein the construction of said electrode part or parts, which is rotationally a symmetrical is located close to said photocathode layer.

17. A device as defined in claim 15, wherein the construction of said electrode part or parts which is rotationally a symmetrical is carried out by means of sheet parts placed on said electrode part or parts.

18. A device as defined in claim 15, wherein said two electrode parts of said cathode electrode closely adjacent said photocathode layer define an annular clearance which is rotationally a symmetrical so that when there are varying potentials at said two electrode parts an electrical lens is formed which is rotationally a symmetrical.

19. A device as defined in claim 15, wherein the construction of said electrode part of parts which is rotationally a symmetrical is carried out so that when there is a voltage difference between said two electrode parts there is a deflection of all electrons emitted by said photocathode layer substantially in one direction transverse to the axis of the tube.

20. A device as defined in claim 15, wherein the construction of said electrode parts which is rotationally a symmetrical is carried out by means of extensions, the extents of which in the longitudinal direction vary axially of the tube along the circumference.

21. A device as defined in claim 15, wherein the construction of said electrode parts, which is rotationally a symmetrical is carried out by providing its inner edge(s) with a different spacing along the circumference with respect to the axis of the tube.

22. A device as defined in claim 15, wherein the construction of said electrode parts, which is rotationally a symmetrical is produced by frusto-conical parts which are rotationally a symmetrical.

23. An image intensifying device comprising a light transmissive photo cathode layer, a cathode electrode including a first annular electrode part electrically connected to said photocathode layer, a second annular electrode part of a larger area than said first annular electrode part, an annular insulating part disposed between said first annular electrode part and said second annular electrode part and electrically insulating said first and second electrode parts from one another, a high value electrical intermediate resistance connecting said first annular electrode to said second annular electrode, a d.c. voltage source, and a high value cathode resistance connecting said first annular electrode part to the negative pole of said d.c. voltage source.

* * * * *